United States Patent [19]

Boyd et al.

[11] Patent Number: 4,552,213

[45] Date of Patent: Nov. 12, 1985

[54] WELLHEAD APPARATUS

[75] Inventors: Jerry K. Boyd, Tomball; Yu C. Chang, Houston, both of Tex.

[73] Assignee: FIP, Inc., Houston, Tex.

[21] Appl. No.: 585,440

[22] Filed: Mar. 8, 1984

[51] Int. Cl.[4] ..... E21B 23/00; E21B 33/03

[52] U.S. Cl. ..... 166/88; 166/82; 166/89; 166/379; 166/380; 166/375; 166/382; 166/387

[58] Field of Search ..... 166/75 R, 75 A, 82, 166/83, 84, 88, 89, 368, 378-382, 387

[56] References Cited

U.S. PATENT DOCUMENTS

| | | | |
|---|---|---|---|
| 2,824,757 | 2/1958 | Rhodes | 166/75 UX |
| 2,842,209 | 7/1958 | Gibson | 166/75 |
| 3,004,778 | 10/1961 | Williams et al. | 166/75 X |
| 3,171,489 | 3/1965 | Cole et al. | 166/368 |
| 3,976,130 | 8/1976 | Chambless et al. | 166/84 |
| 4,367,797 | 1/1983 | Brown | 166/380 |
| 4,458,903 | 7/1984 | Tohill | 166/75 X |

*Primary Examiner*—Stephen J. Novosad
*Attorney, Agent, or Firm*—Vaden, Eickenroht Thompson & Jamison

[57] ABSTRACT

There are disclosed several alternate embodiments of wellhead apparatus of the type in which hydraulic fluid may be transmitted to and/or from a subsurface safety valve or other hydraulically operable device within the well through an annular space formed between the production tubing.

20 Claims, 10 Drawing Figures

32
29
26
44
28
46
41
42
45
31
30
I
44
65
55
47
56
2
57
61
60
3
66
40
27
34
36
35
20
22
37
33
25
T
23
21
24
24
33
36
62
52
50
51
T

26AA
76
43
42AA
46
45
30AA
44A
43
28AA
TAA
42
77
44A
56
60
66
40
34
20
36
33
37
23
24

33
36
74
TAA
TA
72
71
24
73
75

WELLHEAD APPARATUS

This invention relates generally to wellhead apparatus wherein hydraulic fluid may be transmitted to and/or from a subsurface safety valve or other hydraulically operable device within the well through an annular space formed between the production tubing and a casing or other pipe which surrounds the tubing and, with the tubing, is suspended from the tubing head of the apparatus. More particularly, it relates to improved wellhead apparatus of this type wherein both the tubing and casing are suspended from a coupling which in turn is supported within an adapter mounted on and releasably connected to a tubing head, and the annular space between the casing and an outer casing on which the tubing head is mounted is closed by a wrap-around type of seal assembly installed between the inner casing and the bore of the head and in which the casing is sealably slidable, whereby, upon release from the head, the adapter may be raised to lift the lower end of the tubing out of a packer in order that the tubing may be displaced to complete the well.

In one form of this type of apparatus, the hydraulic fluid is transmitted through a tube which is suspended from a port through the coupling for extension downwardly within the annular space, and which has an upper end which connects with an opening into the bore of the adapter connecting with a source of hydraulic fluid externally of the wellhead. Thus, the casing acts as a shroud to protect the tube as the adapter is raised and lowered during installation and completion of the well. In another form of this type of apparatus, a port in the coupling connects an opening to the bore of the adapter leading into and from an external source of hydraulic fluid with the upper end of the annular space, and the lower end of the space is closed by a seal assembly to define a reservoir thereabove for the hydraulic fluid. More particularly, a tube connecting at its upper end with the reservoir is suspended from the seal assembly for extension downwardly to the hydraulically operable means in the well.

In prior apparatus of this type, the coupling is supported from the adapter by means of a threaded connection between them. Hence, during installation, it is necessary to rotate the adapter, and thus the Christmas tree above it, with respect to the coupling. In some cases, it's not possible to do this without first removing parts of the tree. Also, the threads on the coupling and adapter may be galled as the tree is installed. It is an object of this invention to provide apparatus of this type in which the tree may be installed without removal of its parts and without risk of galling threads between the coupling and adapter.

Hydraulic fluid which flows into and out of the opening into the bore of the adapter is confined for fluid connection with the port in the coupling, and thus the upper end of the shrouded tube, or with the reservoir in the annular space, depending on which of the above-described forms of the apparatus is used, by means of seal rings carried about the bore of the adapter for sealably engaging the coupling. The adapter must first be released from the tubing head in order to permit it to be raised and thereby provide access to the seal rings for replacement or repair, or to otherwise work over the apparatus. However, due to their suspension of the tubing and casing from the coupling, and the coupling's threaded connection to the adapter, a workover rig is ordinarily required for this purpose. A further object of this invention is to provide apparatus of the type described which permits these and other workover operations to be performed without a workover rig.

In some cases, the means within the well may have two independent operable pressure responsive mechanisms. Thus, for example, some subsurface safety valves have operators which must be positively shifted in opposite directions in order to open and close the valve. It is therefore another object of this invention to provide apparatus of this general type having a compact arrangement for independently transmitting hydraulic fluid to and from two or more hydraulically operable means within the well.

In the form of the above-described apparatus in which the annular space between the tubing and casing forms a reservoir for the hydraulic fluid, it has been the practice to threadedly connect the upper end of the casing to the lower end of the coupling and the lower end of the casing to a connector including a fitting threadedly connected to the lower end of the tubing so as to close the lower end of the space, and a tube suspended from the fitting for extension downwardly to the hydraulically operable means. The tubing is thus suspended with the casing from the coupling, and the upper end of the tubing extends within seal means carried about the bore of the coupling above a port in the coupling which connects with the opening into bore of the adapter, whereby hydraulic fluid flows through the port into and out of the reservoir. This, however, requires a special joint of tubing, and it is a still further object to provide this form of apparatus in which the joint of tubing may be of standard type normally stocked at the well site.

These and other objects are accomplished, in accordance with the illustrated embodiments of this invention, by means of wellhead apparatus of the type described wherein the coupling has a groove thereabout, and the adapter has a plurality of supporting dogs mounted thereon for movement into and out of the groove.

Thus, with the dogs in the groove, the adapter may be released from the tubing head to raise the coupling and thus the casing and tubing strings with it, without the necessity of rotating the adapter and thus rotating the Christmas tree and its fittings mounted above the adapter. Preferably, the upper ends of the groove and the dogs have inwardly and upwardly tapered surfaces, so that, upon lifting of the adapter, the dogs are prevented from accidental retraction out of supported positions.

In the preferred and illustrated embodiments of the invention, the coupling is supported on the seal assembly to dispose the upper and lower ends of the groove therein respectively above and below the upper and lower ends of the dogs. In this manner, the dogs may be moved out of the groove to permit the adapter to be raised from the coupling, upon release of the adapter from the tubing head, without lifting the tubing and casing. In this manner, it is possible to replace and/or repair the seal rings carried within the bore of the adapter, or to otherwise work over the adapter, without having to lift the weight of the tubing and casing, which, as previously noted, would require the use of a workover rig.

The coupling preferably comprises a main body in which the groove is formed, and a spacer rings which is releasably connected to the lower end of the main body for seating on the hanger. Thus, in accordance with another advantageous feature of the present invention, the spacer ring may be selected to permit the installation of the adapter and coupling of the wellhead apparatus of the present invention on tubing heads of different manufacturers, and thus tubing heads which may have different vertical spacings between their upper ends and the seat in the bore in which the hanger is supported.

In accordance with one illustrated embodiment of the invention, the adapter has first and second openings to its bore, each adapted to connect with an external source of hydraulic fluid, and means about the bore for sealing between the adapter and coupling in order to connect the first opening with a first port in the coupling which connects with the annular space to define a reservoir between the tubing and casing, and to connect the second of the openings with a second port in the tubing from which a tube depends for extension within the reservoir. More particularly, a first tube is suspended from the means which closes the lower end of the reservoir to connect the reservoir and thus the first opening with a first hydraulically operable means with the well, and a second tube extends through the closing means to connect the second opening with a second hydraulically operable means within the well, whereby hydraulically operable means requiring two independent sources of hydraulic fluid may be operated with apparatus of basically the same construction as either of the above-described forms.

In accordance with a still further novel aspect of the present invention, in an improved embodiment of the second described form of wellhead apparatus, the annular space between the tubing and casing is closed by means of a connector including a fitting connected to the lower end of the casing and carrying a seal assembly sealably surrounding the tubing at the lower end of the casing. More particularly, the tubing may be a standard joint which, like the casing, is threadedly connected at their upper ends to the coupling, and a tube extends sealably through the seal assembly for connecting the reservoir within hydraulically operable means within the well.

In the drawings, wherein like reference characters are used throughout to designate like parts:

Figures 1A, 1B:
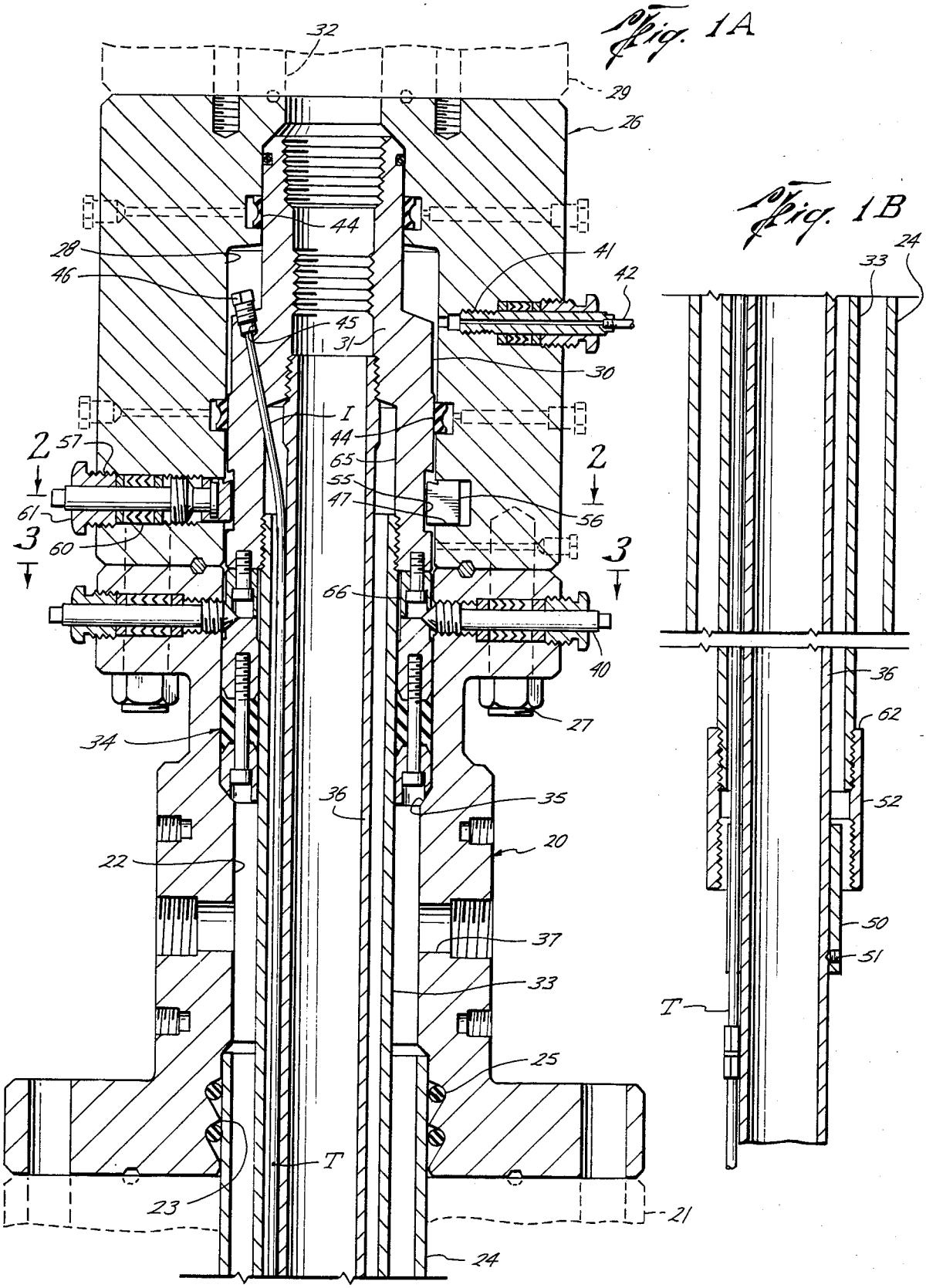
FIG. 1A is a vertical sectional view of the upper end of the above-described embodiment of the apparatus wherein the hydraulic fluid is transmitted to and from the hydraulically operable means through a tube which extends downwardly through the annular space between the tubing and casing.
FIG. 1B is a vertical sectional view of the lower end of the apparatus wherein the inner casing and tubing extend downwardly from the lower end of the tubing head and the tubing and tube extend downwardly from the inner casing.
Figure 6A:
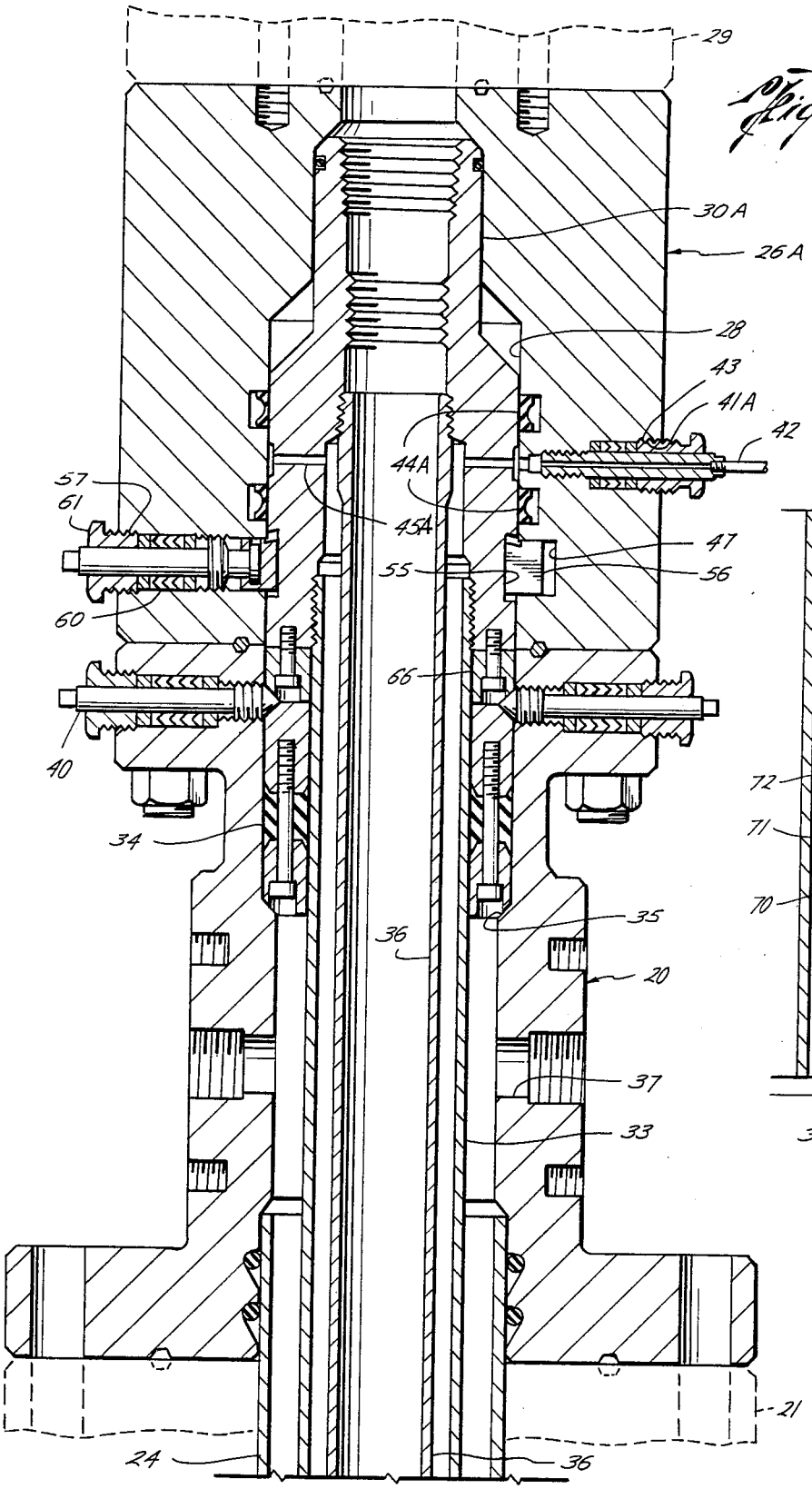
Figure 6B:
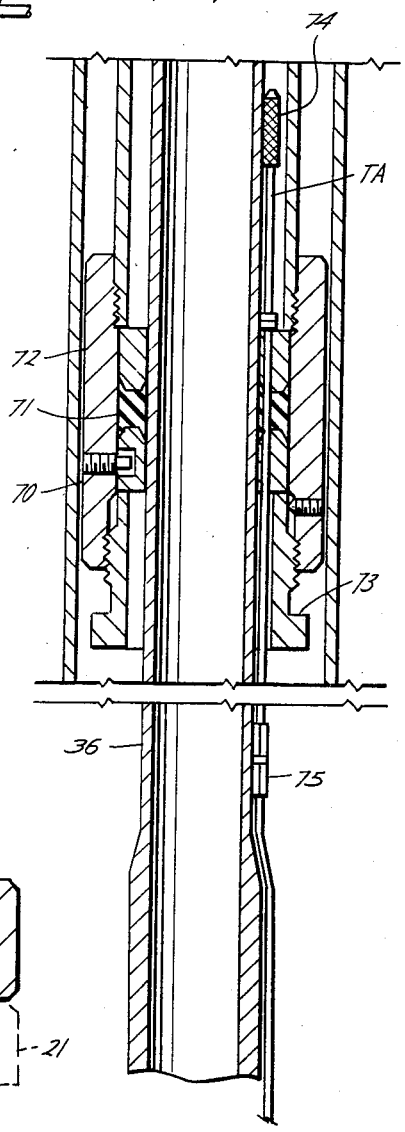
Figure 7A:
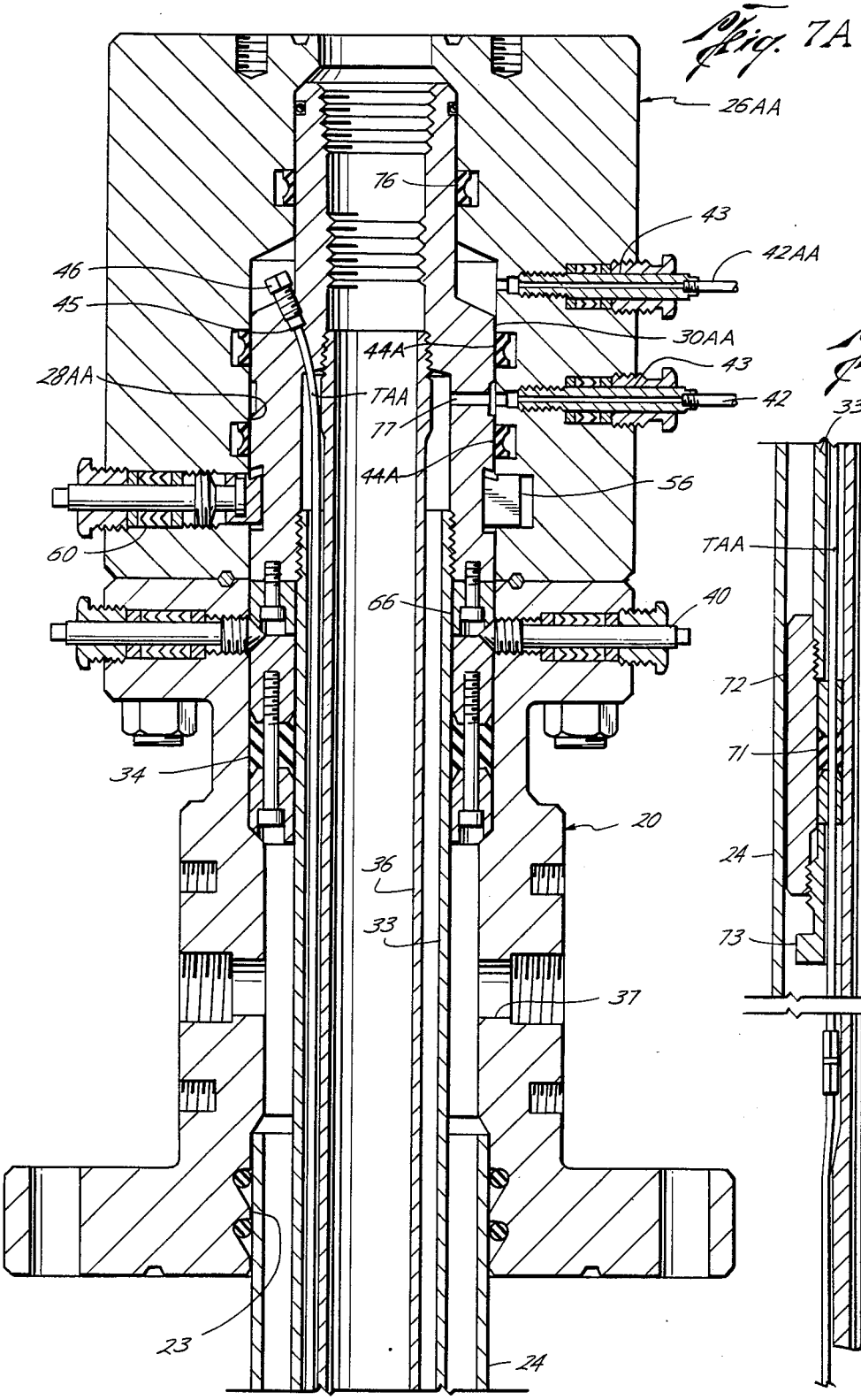
Figure 7B:
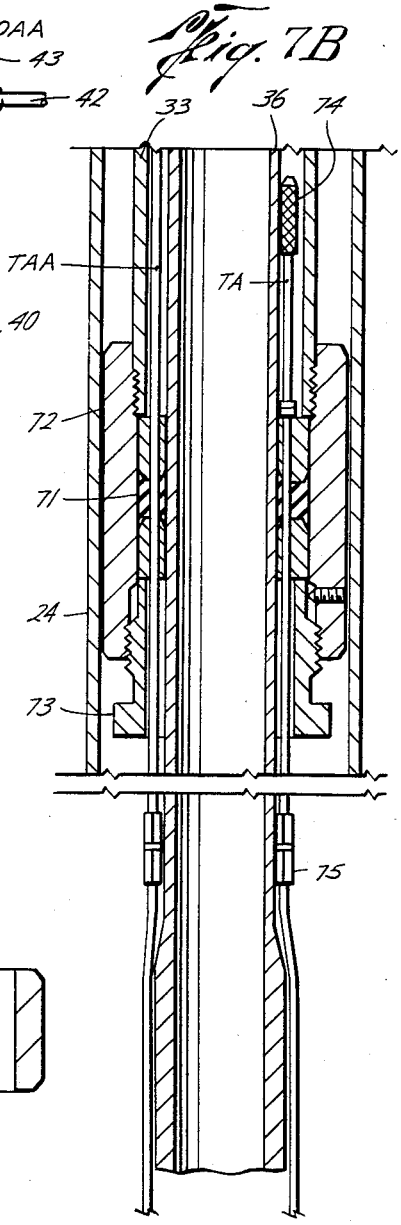

FIGS. 6A and 6B are vertical sectional views similar to FIGS. 1A and 1B, but of the above-described form of the apparatus in which the lower end of the annular space between the tubing and casing is closed to form a reservoir for the hydraulic fluid; and FIGS. 7A and 7B are vertical sectional views, similar to FIGS. 1A and 1B, but showing the above-described embodiment of the invention wherein means are provided for independently transmitting hydraulic fluid to and from two hydraulically operable means within the wellhead, one through a reservoir formed within the annular space and another through a tube extending through the reservoir and the closing means at the lower end of the reservoir.

With reference now to the details of the above-described drawings, the embodiment of the wellhead apparatus which is illustrated in connection with FIGS. 1 to 5 includes a tubing head 20 of conventional construction which is adapted to be mounted on and releasably connected to a casing head 21 shown in broken lines. When the tubing head is so mounted, a bore 22 therethrough is axially aligned with the bore through the casing head, and a counterbore 23 at its lower end surrounds the upper end of an outer, conductor casing 24 suspended within the bore of the casing head 21. Seal rings 25 carried within the counterbore sealably engage the upper end of the conductor casing received therein.

An adapter spool 26 mounted on and releasably connected to the upper end of the tubing head by means of bolts 27 has a bore 28 therethrough which is axially aligned with the bore 22 of the tubing head, when the adapter is mounted thereon, and a Christmas tree 29 shown in broken lines is adapted to be mounted on and releasably connected to the upper end of the adapter spool. The upper end of the tubing head bore 22 and lower end of the adapter bore 28 are enlarged and of essentially the same diameter to receive a coupling 30 which is releasably supported from the adapter 26, as will be described in more detail to follow. As shown, the coupling has a bore 31 therethrough which, when it is so supported, is axially aligned with the upper reduced portion of the bore 28 in the adapter, and thus with the lower end of the bore 32 in the Christmas tree 29.

An inner casing 33 is threadedly connected to the lower end of the bore 31 of the coupling 30 for extension downwardly through the bore 22 of the tubing head and into the outer connector casing 24 therebelow, and an inner production tubing 36 is threadedly connected at its upper end to an intermediate portion of the bore 31 for suspension from the coupling and extension downwardly within the inner casing 33. As previously mentioned, and as will be described in detail to follow, the annular space formed between tubing 36 and inner casing 33 provides a means by which hydraulic fluid may be transmitted to and from hydraulically operable means within the well.

The upper end of the annular space between the inner casing 33 and the bore 22 and outer casing 24 is closed by a seal assembly 34 supported on a seat 35 formed at the lower end of the upper enlarged diameter portion of the bore 22, so as to connect the space with outlets 37 formed in the tubing head. More particularly, the seal assembly is split about its circumference to permit it to be wrapped around casing 33 and lowered therewith onto seat 35, and is of conventional construction including a seal ring of resilient material held between upper and lower rigid rings. An outer tapered shoulder about the upper end of ring is adapted to be engaged by the inner conical ends of pins 40 mounted on the tubing head for forcing the upper body downwardly so as to expand the seal ring and thus cause its inner and outer diameters to sealably engage the inner casing 33 and bore of the tubing head.

The lower end of the coupling 30 is seated upon the upper end of the seal assembly so as to support both the inner casing and tubing 36 for extension downwardly within outer casing 24. The upper reduced end of coupling 30 is received in a counterbore in the upper end of bore 28 of adapter 26, and a seal ring thereabout is sealably engaged with the counterbore.

A conduit 42 connecting with an external source of hydraulic fluid (not shown) connects with a fitting 43 mounted within an opening 41 through the adapter and having a hole therethrough end connecting with the intersection of the opening with the bore 28 of the adapter. More particularly, the opening connects with the bore intermediate seal rings 44 carried within the bore for sealing about the coupling, whereby hydraulic fluid is confined to the annular space between the seal rings. As shown, fitting 43 is surrounded by packing within the opening on the adapter and expanded into sealing engagement with the fitting and opening by a gland nut threaded to the outer end of the opening.

Coupling 30 has a port 45 therein to receive a tube T having a fitting 46 at its upper end having tapered threads connected to the port to suspend the tube from the coupling and seal the tube with respect to the port so as to connect its upper end with the opening to the space between the adapter and coupling intermediate seal rings 44. The tube extends through the annular space between the bore of the coupling and the production tubing 36, and into the annular space between the production tubing and the inner casing 33. Thus, as shown in FIG. 1B, the tube extends downwardly through the lower end of the annular space and below inner casing 36 for connection at its lower end to the hydraulically operable means (not shown) within the well. As shown in FIG. 1B, a sleeve 50 is releasably connected to the production tubing by a set screw 51 with its upper end extending within the lower end of a coupling 52 at the lower end of the inner casing 33, and the tube T extends through a hole in the sleeve 50 so as to be held in a relatively fixed position as it passes out through the lower end of the annular space.

Figure 2:
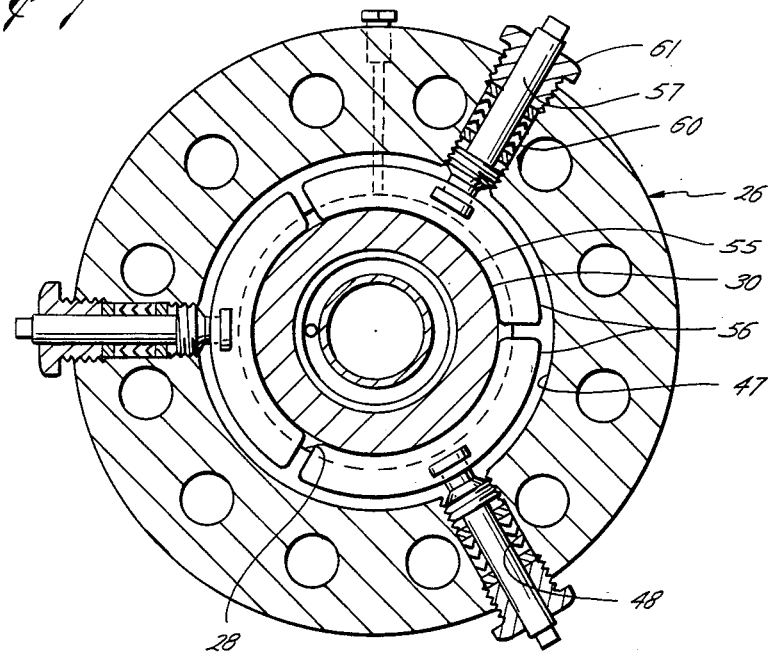
FIG. 2 is horizontal cross-sectional view of the adapter, as seen along broken lines 2—2 of FIG. 1A.
Figure 3:
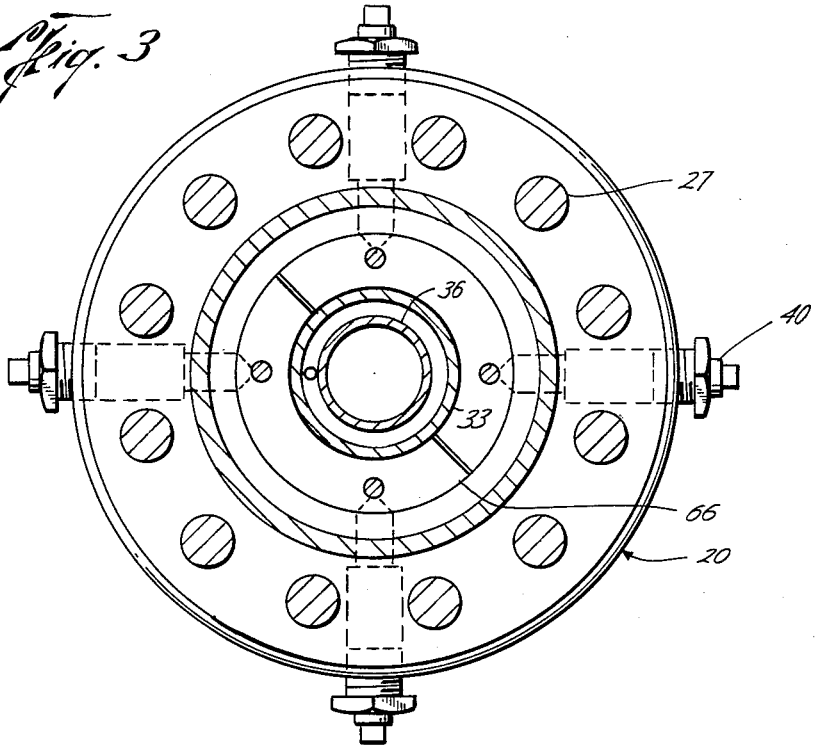
FIG. 3 is a horizontal cross-sectional view of the apparatus, as seen along broken lines 3—3 of FIG. 1A, and thus from the top of the tubing head.
Figure 4:
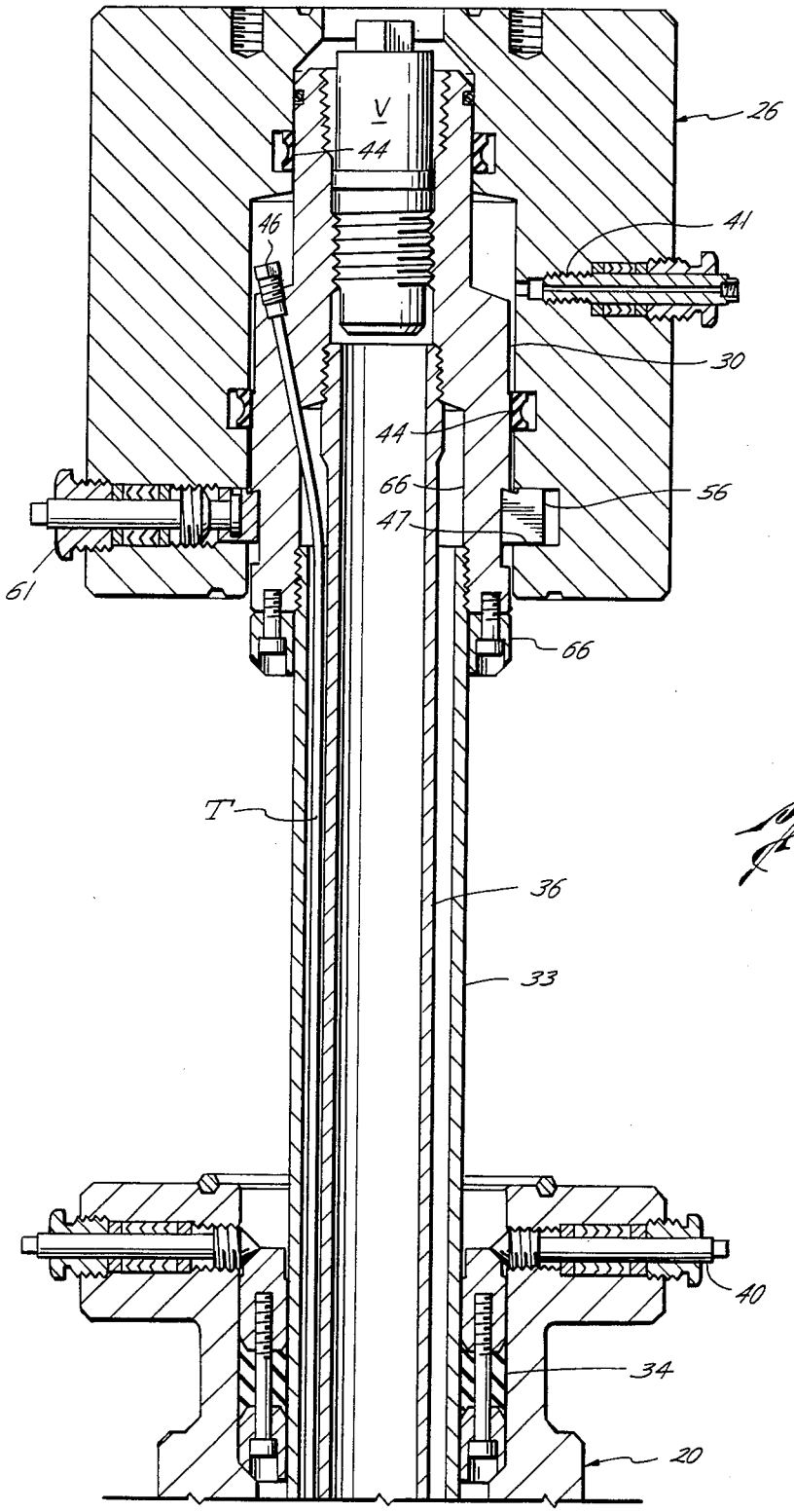
FIG. 4 is another vertical cross-sectional view of the apparatus but upon release of the adapter from the tubing head and lifting of the adapter to raise the coupling and tubing and casing suspended therefrom.
Figure 5:
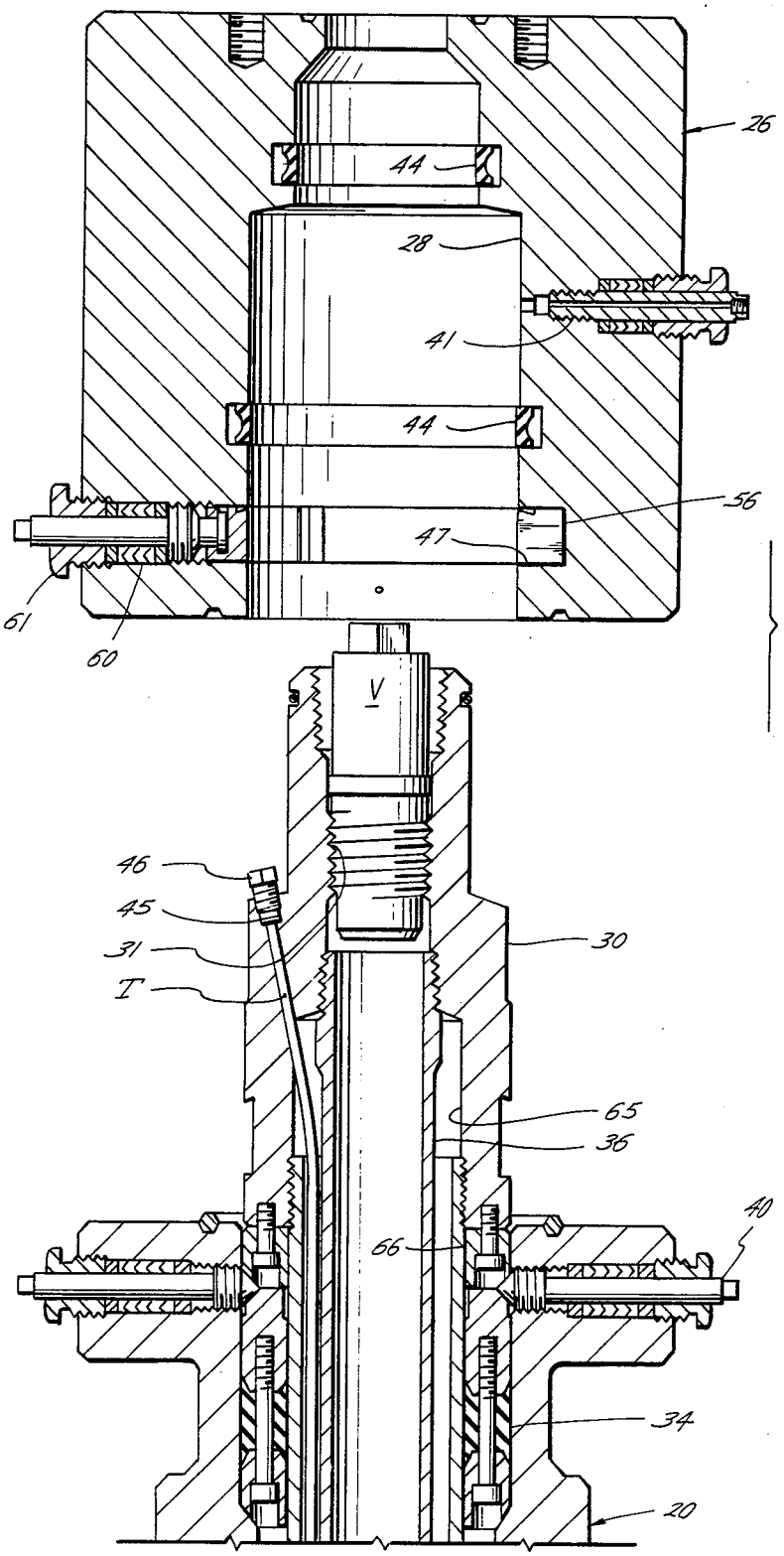
FIG. 5 is another vertical sectional view of such embodiment of the apparatus, but upon retraction of the locking dogs from the coupling groove, and release of the adapter from the tubing head to permit the adapter to be raised above the coupling.

A groove 55 is formed about the outer diameter of coupling 30 beneath the engagement of lower seal ring 44 thereabout, and a plurality of arcuately shaped dogs 56 are mounted within an annular recess 47 in the bore of the adapter opposite the groove 55 for movement radially inwardly and outwardly with respect to the bore 28 of the adapter. As shown in FIGS. 1A and 2, the dogs have T-slots to receive T-heads on the inner ends of rods 57 threadedly mounted within openings 48 in the adapter connecting at their inner ends with the recess 47. Thus, the outer ends of the rods may be to move the dogs between their inner positions within the groove 55, as shown in FIGS. 1A, 2, and 4, and outer positions in which their inner ends are withdrawn from the groove and substantially aligned with the enlarged lower portion of the bore 28 of the adapter, as shown in FIG. 5. The rods are surrounded by packing 60 which is caused to sealably engage with the rod and the openings in the adapter by means of a gland nut 61 threaded to the outer ends of the openings. As shown in FIG. 2, when in their inner positions, the inner edges of the dogs 56 abut the groove so as to limit further inward movement.

As shown in FIG. 1A, when the coupling 30 and thus the production tubing and inner casing are supported on the seal assembly 34, and thus from the tubing head 20, the upper and lower edges of groove 55 are spaced respectively above and below the upper and lower sides of the inner ends of the dogs 56. Thus, for the purpose previously described and to be discussed in more detail to follow in connection with FIG. 5, the dogs may be retracted from their inner positions so that, when the bolts 27 are released, adapter 26 may be raised from the tubing head 20 as well as coupling.

On the other hand, and as also previously mentioned, in order to complete the well, the lower end of the production tubing 36 must be lifted out of the bore of the packer within the well. For this purpose, however, upon release of the adapter from the tubing head, and raising of the adapter thereabove, the dogs are within the groove 55 so that the upper sides of the dogs move upwardly to engage the upper end of the groove, and thus support the coupling and thus the tubing and inner casing for raising with the adapter. As shown in FIG. 4, as the inner casing 33 is raised with the adapter, it slides upwardly within the seal assembly 34 to serve as a shround which protects the hydraulic fluid tube 45. Ordinarily, it's necessary to raise the tubing less than the length of a single joint, but in any event, upward movement of the tubing will be limited by engagement of a shoulder 62 (FIG. 1B) on the upper end of coupling 52 with the lower end of seal assembly 34.

The upper end of the groove 55, as well as the upper sides of the inner ends of the dogs 56 are tapered inwardly and upwardly so that, when the coupling is supported from the dogs, the dogs are positively held against movement outwardly. Consequently, it's not possible to release the dogs and thus permit the coupling to be dropped during raising and lowering of the coupling with the adapter during the completion operation.

If, on the other hand, it is desired to replace or repair the seals 44, or otherwise workover the inner diameter of the adapter, the rods 57 are backed off to move the supporting dogs 56 out of the groove 55, as shown in FIG. 5, whereby, as above noted, the bolts 27 may be released to permit the adapter to be lifted from the upper end of the coupling 30, as shown in FIG. 5, without having to lift the coupling and the production tubing and inner casing therewith. Then, when the seals have been repaired or replaced, or other workover operations performed, the adapter may be lowered into place about the coupling, and releasably locked to the tubing head, and the dogs 56 then moved inwardly to the position of FIGS. 1A and 2. As shown in FIG. 4, and in accordance with standard procedures well known in the art, a back pressure valve V is installed within the bore of the coupling to contain flow upwardly through the tubing.

Coupling 30 is made up of an upper main body 65 to which the inner production tubing and inner casing are threadedly connected, and in which groove 55 is formed, and a lower, split adapter ring 66 bolted to the lower end of main body 65 and adapted to seat on the upper end of the seal assembly 34. As previously described, the adapter ring may be selected to enable the coupling to be used with conventional tubing heads of different manufacturers, which might differ from one another only insofar as the vertical spacing between the seat 35 and upper end of the tubing head is concerned.

The embodiment of the invention illustrated in connection with FIGS. 6A and 6B is similar in many respects to that of FIGS. 1 to 5, and, for this reason, many of its parts which are identical bear the same reference characters, and other parts which are related bear reference characters differing only by the addition of the suffix "A". Thus, for example, this second embodiment also includes a tubing head 20 having a bore 22 therethrough adapted to be mounted on and releasably connected to the upper end of casing head 21, and having a counterbore at its lower end to sealably surround the upper end of an outer casing 24 suspended from the casing head. In like manner, an adapter 26A of generally the same construction is mounted on and releasably connected to the upper end of tubing head 20 by means of bolts 27, and a coupling 30A is disposed within the bore of the adapter and supported on a seal assembly 34 supported on a seat 35 in the bore of the head 20. As above described, the seal assembly closes the upper end of an annular space between the bore of the tubing head and outer casing 24 and an inner casing 33 suspended from the coupling and surrounding a production tubing 36 which is also suspended from the coupling.

The primary difference between the embodiment of FIGS. 6A and 6B and that of FIGS. 1 to 5 resides in the manner in which hydraulic fluid is transmitted through the annular space between the production tubing and the inner casing between an external source of such fluid and hydraulically operable means within the well. Thus, in the embodiment of FIGS. 6A and 6B, the control fluid conduit 42 connecting with a fitting 43 in an opening 41A in the adapter which in turn connects with the bore 28 in the adapter intermediate seal rings 44A both of which seal about the enlarged intermediate portion of the coupling 30A. Thus, as compared with the embodiment of FIGS. 1 to 5, the opening 41A in the adapter to receive the fitting is somewhat lower than that shown in the prior embodiment.

Also, ports 45A are formed in the coupling to connect at their outer end intermediate the seal rings and their inner ends with the upper end of the annular space between the production tubing and inner casing. Thus, as previously noted, in this embodiment of the invention, the space serves as a reservoir for the hydraulic fluid which is closed at its lower end by means of a connector 70 (FIG. 6B) having a fitting 72 carrying a seal assembly 71 at the lower end of the inner casing in position to seal between the fitting and the production tubing. The connector also includes a gland nut 73 threadedly connected to the fitting to permit the seal ring of the seal assembly to be expanded into sealing engagement between the production tubing and fitting.

As shown in FIG. 6B, a tube TA extends through a hole in the seal assembly 71 to connect at its upper end with the lower end of the annular space or reservoir and to extend downwardly from the seal assembly and along the side of the production tubing 36. There is a strainer 74 on the upper end of the tube and a coupling 75 at its lower end which is connected to an extension of the tube extending downwardly to the hydraulically operable means. As shown in FIG. 6B, and as will be apparent to one skilled in the art, the fitting 72 including the gland nut 73 are arranged a sufficient distance above the lowermost upset on the tubing 33 so as to permit assembly of the seal assembly and fitting. Also, of course, expansion of the seal assembly will seal about tube TA as it seals with fitting 71 and the tubing to close the lower end of the annular space.

The wellhead apparatus illustrated in FIGS. 6A and 6B functions similarly to the embodiment of FIGS. 1 to 5 in that, with the locking dogs 56 in the groove 55 about coupling 30A, as shown in FIG. 6A, and upon release and lifting of the adapter from the tubing head, the production tubing and inner casing may be lifted with the coupling during completion of the well. Also, of course, and again as described in connection with the embodiment of FIGS. 1 to 5, the locking dogs may be retracted from the groove 35 and into recess 47, so that, upon release of the bolts 27, the adapter spool may be lifted from the coupling without lifting the production tubing and inner casing therewith.

The embodiment of the invention of the wellhead apparatus shown in FIGS. 7A and 7B is very similar to that of FIGS. 6A and 6B, and thus corresponding parts bear the same reference characters, except for the fact that, as previously described, it provides a second means by which hydraulic fluid may be transmitted between an external source and the hydraulically operable means in the well. As previously mentioned, apparatus of this type is useful in the event the means in the well requires hydraulic operation from two separate sources of hydraulic fluid, and/or alternatively from a single source, but wherein such means includes ports requiring separate and individual operation. In any event, and again as previously described, this second means for transmitting the hydraulic fluid comprises a tube TAA which, as in the case of the tube T of the embodiment of FIGS. 1 to 5, extends through a port in a coupling 30AA and has a fitting 46 at its upper end connected to the upper end of the port for suspension from the coupling within the annular space between the production tubing 36 and inner casing 33, and thus from the lower of the space to hydraulically operable means within the well.

As shown, this embodiment also includes a second conduit 42AA connecting with the same or a different external source of hydraulic fluid and with a fitting mounted with an opening in the adapter 26AA having an inner end which connects with the bore 28AA of the adapter above upper seal ring 44A and below an additional seal ring 76 carried within the counterbore at the upper end of the bore of the adapter and sealably surrounding the upper end of the coupling. Thus, the seal rings 44A and 76 form between them another isolated annular space for connection with the upper end of tube TAA.

As shown in FIG. 7B, the lower end of the tube TAA extends through a hole in the seal assembly 71 carried by the fitting 72, which is circumferentially spaced from and may be diametrically opposed to the hole through which the tube TA extends. As also shown in FIG. 7B, and as described in connection with FIGS. 6A and 6B, the upper end of the tube TA connects with the reservoir formed in the annular space between the production tubing and inner casing, which in turn connects at its upper end with port 77 in the coupling 30AA.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations.

This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. Wellhead apparatus, comprising a tubing head adapted to be mounted on a casing head, said head having a bore therethrough with a seat in the bore, an adapter adapted to be mounted on and releasably connected to the tubing head, said adapter having a bore therethough whose lower end is aligned with the bore of the tubing head above the seat, when so connected, a coupling disposable within the bore of the adapter, said coupling having a bore therethrough which is aligned with the upper end of the bore of the adapter, when so disposed, a casing suspended from the coupling in alignment with the coupling bore and extending therefrom within the tubing head, a tubing suspended from the coupling within the casing in alignment with the coupling bore and extending therefrom below the casing and spaced therefrom to provide an annular space therebetween, an assembly adapted to be disposed about the casing and supported on the seat in the bore of the head for sealing between the casing and the head, said adapter having an opening into its bore for connection with an external source of hydraulic fluid, means including seal means about the bore of the adapter for sealing between the adapter and the coupling and a port in the coupling for connecting the opening with the annular space, and means for transmitting hydraulic fluid through said space to and from hydraulically operable means within the well, said coupling having a groove thereabout, and said adapter having a plurality of supporting dogs mounted thereon for movement into and out of the groove, whereby with the dogs in the groove, and the adapter released from the tubing head, the coupling is supported from the adapter to permit the casing and tubing strings to be raised therewith.

2. Wellhead apparatus of the character defined in claim 1, wherein the upper ends of the groove and dogs have inwardly and upwardly tapered surfaces to prevent retraction of the dogs when the coupling is supported therefrom.

3. Wellhead apparatus of the character defined in claim 1, wherein both the casing and tubing are threadedly connected to the coupling for suspension therefrom.

4. Wellhead apparatus of the character defined in claim 1, including means closing the lower end of the annular space between the tubing and casing, and a tube depending from the closing means to connect the annular space thereabove with the hydraulically operable means.

5. Wellhead apparatus of the character defined in claim 1, including a tube supported from the coupling port for extension downwardly from the coupling and through the annular space.

6. Wellhead apparatus of the character defined in claim 1, wherein the coupling is supported on the hanger to dispose the upper and lower ends of the groove above and below the upper and lower ends of the dogs, so that the dogs may be moved out of the groove to permit the adapter to be raised from the coupling, upon release of the adapter from the tubing head, without lifting the tubing and casing.

7. Wellhead apparatus of the character defined in claim 6, wherein the upper ends of the groove and dogs have inwardly and upwardly tapered surfaces so than, when the dogs are in the groove and the adapter is released and raised from the head to support the coupling from the dogs, the dogs cannot be rêtracted.

8. Wellhead apparatus of the character defined in claim 6, wherein the coupling includes a main body in which the groove is formed, and a spacer ring releasably connected to the lower end of the main body for engaging the seat on the hanger.

9. Wellhead apparatus, comprising a tubing head adapted to be mounted on a casing head, said head having a bore therethrough with a seat in the bore, an adapter adapted to be mounted on and releasably connected to the tubing head, said adapter having a bore therethrough whose lower end is aligned with the bore of the tubing head above the seat, when so connected, a coupling disposable within the bore of the adapter, said coupling having a bore therethrough aligned with the upper end of the bore of the adapter, when so disposed, a casing suspended from the coupling in alignment with the coupling bore and extending therefrom within the tubing head, a tubing suspended from the coupling within the casing in alignment with the coupling bore and extending therefrom below the casing and spaced therefrom to provide an annular space therebetween, an assembly adapted to be disposed about the casing and supported on the seat in the bore of the head for sealing between the casing and the head, means for supporting the coupling from the adapter, whereby, upon release of the adapter from the tubing head, the casing and tubing strings may be raised with the adapter and coupling, said adapter having first and second openings into its bore, each for connection with an external source of hydraulic fluid, and means including seal means about the bore of the adapter for sealing between the adapter and the coupling and first and second ports in the coupling for connecting the first and second openings, respectively, with the annular space, means closing the lower end of the annular space between the tubing and casing, a first tube depending from the closing means to connect the space thereabove and thus the first opening with a first hydraulically operable means within the well, and a second tube supported from the second coupling port and extending within the annular space and through the closing means to connect the second opening with a second hydraulically operable means within the well.

10. Wellhead apparatus, comprising a tubing head adapted to be mounted on a casing head, said head having a bore therethrough with a seat in the bore, an adapter adapted to be mounted on and releasably connected to the tubing head, said adapter having a bore therethrough whose lower end is aligned with the bore of the tubing head above the seat, when so connected, a coupling disposable within the bore of the adapter, said coupling having a bore therethrough which is aligned with the upper end of the bore of the adapter, when so disposed, a casing threadedly connected to the coupling in alignment with the coupling bore and extending within the tubing head, a tubing threadedly connected to the coupling within the casing in alignment with the coupling bore and extending therefrom below the casing to provide an annular space between them, an assembly adapted to be disposed about the casing and supported on the seat in the bore of the head for sealing between the casing and the head, said adapter having an opening into its bore for connection with an external source of hydraulic fluid, means including seal means about the bore of the adapter for sealing between the adapter and the coupling and a port in the coupling for connecting the opening with the annular space, means for closing the lower end of the annular space including a connector carrying a seal assembly surrounding the tubing at the lower end of the casing, a tube extending sealably through the seal assembly to connect the annular space with hydraulically operable means within the well, and means for supporting the coupling from the adapter, whereby, upon release of the adapter from the tubing head, the casing and tubing may be raised from the adapter and coupling.

11. For use with a tubing head adapted to be mounted on a casing head, and having a bore therethrough with a seat in the bore; apparatus comprising, an adapter adapted to be mounted on and releasably connected to the tubing head, said adapter having a bore therethrough whose lower end is aligned with the bore of the tubing head above the seat, when so connected, a coupling disposable within the bore of the adapter, said coupling having a bore therethrough which is aligned with the upper end of the bore of the adapter, when so disposed, a casing suspended from the coupling in alignment with the coupling bore and extending therefrom within the tubing head, a tubing suspended from the coupling within the casing in alignment with the coupling bore and extending therefrom below the casing and spaced therefrom to provide an annular space therebetween, an assembly adapted to be disposed about the casing and supported on the seat in the bore of the head for sealing between the casing and the head, said adapter having an opening into its bore for connection with an external source of hydraulic fluid, means including seal means about the bore of the adapter for sealing between the adapter and the coupling and a port in the coupling for connecting the opening with the annular space, and means for transmitting hydraulic fluid through said space to and from hydraulically operable means within the well, said coupling having a groove thereabout, and said adapter having a plurality of supporting dogs mounted thereon for movement into and out of the groove, whereby, with the dogs in the groove, and the adapter released from the tubing head, the coupling is supported from the adapter to permit the casing and tubing strings to be raised therewith.

12. Apparatus of the character defined in claim 11, wherein the upper ends of the groove and dogs have inwardly and upwardly tapered surfaces to prevent retraction of the dogs when the coupling is supported therefrom.

13. Apparatus of the character defined in claim 11, wherein both the casing and tubing are threadedly connected to he coupling for suspension therefrom.

14. Apparatus of the character defined in claim 11, including means closing the lower end of the annular space between the tubing and casing, and a tube depending from the closing means to connect the annular space thereabove with the hydraulically operable means.

15. Apparatus of the character defined in claim 11, including a tube supported from the coupling port for extension downwardly from the coupling and through the annular space.

16. Apparatus of the character defined in claim 11, wherein the coupling is supported on the hanger to dispose the upper and lower ends of the groove above and below the upper and lower ends of the dogs, so that the dogs may be moved out of the groove to permit the adapter to be raised from the coupling, upon release of the adapter from the tubing head, without lifting the tubing and casing.

17. Apparatus of the character defined in claim 16, wherein the upper ends of the groove and dogs have inwardly and downwardly tapered surfaces so than, when the dogs are in the groove and the adapter is released and raised from the head to support the coupling from the dogs, the dogs cannot be retracted.

18. Apparatus of the character defined in claim 16, wherein the coupling includes a main body in which the groove is formed, and a spacer ring releasably connected to the lower end of the main body for engaging the seat on the hanger.

19. For use with a tubing head adapted to be mounted on a casing head, and having a bore therethrough with a seat in the bore; apparatus comprising, an adapter adapted to be mounted on and releasably connected to the tubing head, said adapter having a bore therethrough whose lower end is aligned with the bore of the tubing head above the seat, when so connected, a coupling disposable within the bore of the adapter, said coupling having a bore therethrough aligned with the upper end of the bore of the adapter, when so disposed, a casting suspended from the coupling in alignment with the coupling bore and extending therefrom within the tubing head, a tubing suspended from the coupling within the casing in alignment with the coupling bore and extending therefrom below the casing and spaced therefrom to provide an annular space therebetween, an assembly adapted to be disposed about the casing and supported on the seat in the bore of the head for sealing between the casing and the head, means for supporting the coupling from the adapter, whereby, upon release of the adapter from the tubing head, the casing and tubing strings may be raised with the adapter and coupling, said adapter having first and second openings in its bore, each for connection with an external source of hydraulic fluid, and means including seal means about the bore of the adapter for sealing between the adapter and the coupling and first and second ports in the coupling for connecting the first and second openings, respectively, with the annular space, means closing the lower end of the annular space between the tubing and casing, a first tube depending from the closing means to connect the space thereabove and thus the first opening with a first hydraulically operable means within the well, and a second tube supported from the second coupling port and extending within the annular space and through the closing means to connect the second opening with a second hydraulically operable means within the well.

20. Apparatus for use with a tubing head adapted to be mounted on a casing head, and having a bore therethrough with a seat in the bore; apparatus comprising an adapter adapted to be mounted on and releasably connected to the tubing head, said adapter having a bore therethrough whose lower end is aligned with the bore of the tubing head above the seat, when so connected, a coupling disposable within the bore of the adapter, said coupling having a bore therethrough which is aligned with the upper end of the bore of the adapter, when so disposed, a casing threadedly connected to the coupling in ailgnment with the coupling bore and extending within the tubing head, a tubing threadedly connected to the coupling within the casing in alignment with the coupling bore and extending therefrom below the casing to provide an annular space between them, an assembly adapted to be disposed about the casing and supported on the seat in the bore of the head for sealing between the casing and the head, said adapter having an opening into its bore for connection with an external source of hydraulic fluid, means including seal means about the bore of the adapter for sealing between the adapter and the coupling and a port in the coupling for connecting the opening with the annular space, means for closing the lower end of the annular space including a connector carrying a seal assembly surrounding the tubing at the lower end of the casing, a tube extending sealably through the seal assembly to connect the annular space with hydraulically operable means within the well, and means for supporting the coupling from the adapter, whereby, upon release of the adapter from the tubing head, the casing and tubing may be raised from the adapter and coupling.

* * * * *